US007642663B2

(12) United States Patent
Mantei et al.

(10) Patent No.: US 7,642,663 B2
(45) Date of Patent: Jan. 5, 2010

(54) MOBILE WEAR AND TEAR RESISTANT GAS COMPRESSOR

(75) Inventors: Kelly Paul Francis Mantei, Calgary (CA); Long Han Ta, Calgary (CA); Chaince Melvin Pedersen, Calgary (CA); Barry Patrick McGrath, Calgary (CA)

(73) Assignees: Bidell Equipment Limited Partnership, Calgary (CA); Total Energy Services Ltd., Calgary (CA)

( * ) Notice: Subject to any disclaimer, the term of this patent is extended or adjusted under 35 U.S.C. 154(b) by 530 days.

(21) Appl. No.: 11/551,075

(22) Filed: Oct. 19, 2006

(65) Prior Publication Data

US 2008/0095644 A1 Apr. 24, 2008

(51) Int. Cl.

| | |
|---|---|
| ***B62D 21/20*** | (2006.01) |
| ***B62D 21/14*** | (2006.01) |
| ***B60P 3/00*** | (2006.01) |
| ***F04B 17/06*** | (2006.01) |
| ***F04B 41/00*** | (2006.01) |
| ***F04D 25/00*** | (2006.01) |
| ***F16F 15/023*** | (2006.01) |
| ***F16M 1/00*** | (2006.01) |

(52) U.S. Cl. ..... 290/1 R; 410/2; 410/44; 410/56; 296/184.1

(58) Field of Classification Search ..... 296/184.1; 417/234; 410/80, 2, 44, 45, 46, 53, 56, 60; 290/1 R See application file for complete search history.

(56) References Cited

U.S. PATENT DOCUMENTS 4,127,300 A * 11/1978 Melley et al. ..... 290/1 R
5,517,822 A * 5/1996 Haws et al. ..... 60/618
5,881,990 A * 3/1999 Kawamura ..... 248/638
6,334,746 B1 1/2002 Nguyen et al.
6,626,646 B2 9/2003 Rajewski
7,051,818 B2 5/2006 Crawford et al.

FOREIGN PATENT DOCUMENTS

| | | |
|---|---|---|
| CA | 2206675 | 6/1997 |
| CN | 2760379 Y | 2/2006 |
| RU | 2155681 | 9/2000 |
| WO | WO 2008046229 A1 * | 4/2008 |

OTHER PUBLICATIONS

Benjamin A. White, P.E., Mechanical Modeling of Compressor Manifold Systems—Part I, Compressor TechTwo, Mar. 2006, pp. 81-85, USA.

Benjamin A. White, P.E., Mechanical Modeling of Compressor Manifold Systems—Part III, Compressor TechTwo, Jun. 2006, pp. 38, 40, 42, 44 and 46, USA.

* cited by examiner

*Primary Examiner*—Patricia L Engle
(74) *Attorney, Agent, or Firm*—Bennett Jones LLP

(57) ABSTRACT

A mobile high horsepower rating natural gas compression package is provided. The apparatus includes a trailer having a flexible pre-cambered frame configured to absorb shock during transport and dissipate vibration during operation, and an inflexible sub-skid attached to the flexible frame. A high horsepower rating engine driven compressor is attached to the sub-skid while ancillary compression package components are attached to the flexible frame. An arrangement of break flanges is employed to permit relative motion between the compressor and the ancillary compression package components during transport and operation.

22 Claims, 5 Drawing Sheets

MOBILE WEAR AND TEAR RESISTANT GAS COMPRESSOR

FIELD OF THE INVENTION

The invention relates to mobile natural gas compression packages, and in particular to a wear and tear resistant mobile gas compressor.

BACKGROUND OF THE INVENTION

Natural gas compressors are employed in oil and gas production to provide a pressure boost for conveying natural gas along a natural gas aggregation, transport, and distribution network. Natural gas compressors are typically used on-site close to a producing well, and can also be employed at any point in the network between producing wells and the final point of consumption/sale. It is typical for natural gas compressors to be associated with network nodes. Producing wells and aggregation network nodes are often located in geographically remote areas.

Natural gas compressors range in horsepower rating. Mobile or semi-permanent compressors generally vary between one hundred horsepower to over one thousand horsepower. The horsepower rating generally varies with the physical size of the compressor. Scalability issues plague mobile compressors. Mobile compressors having a horsepower rating above five hundred horsepower suffer from disproportionately high maintenance and are found to be unreliable given potential production losses. To date, mobile compressor applications have been limited to short term use as a substitute during semi-permanent compressor maintenance.

In providing high horsepower rating natural gas compression services, generally accepted principles in the art point to the use of semi-permanent installations. In some applications, semi-permanent installations are generally not cost effective for short term or restricted access use, as a lot of specialized equipment and highly skilled personnel has to be brought to, and from, a geographically remote site. Some natural gas production projects are not undertaken or suffer from reduced profitability due to higher site preparation, transportation, installation, teardown and site reclamation costs associated with semi-permanent installations.

There is a need in to mitigate the above-mentioned issues in order to improve operating performance and thereby minimize costs.

SUMMARY OF THE INVENTION

In accordance with an aspect of the invention there is provided a mobile unitary high horsepower rated natural gas compression package including: a trailer having a pre-cambered frame configured to flex during transport and in response to vibration during operation, and an inflexible sub-skid attached to the flexible frame; an engine driven compressor fixedly attached to the inflexible sub-skid; a plurality of ancillary compression package components attached to the flexible frame; and an arrangement of break flanges configured to permit flexure between the compressor and at least one of the ancillary compression package components.

In accordance with another aspect of the invention there is provided a horizontal gas scrubber affixed to the sub-skid.

In accordance with a further aspect of the invention there is provided a cooler and an adjustable cooler support.

In accordance with a further aspect of the invention there is provided an expansion building.

In accordance with a further aspect of the invention there is provided a pullout arrangement providing extra working area about the compression package during operation, while adhering to transport standards.

In accordance with a further aspect of the invention there is provided a disk style muffler providing sound deadening in use while adhering to transport standards.

In accordance with yet another aspect of the invention there is provided a removable disk style muffler aligned with the at least one removable roof panel of the building.

The advantages are derived from a more reliable compression package, which reduces downtime and operating costs.

BRIEF DESCRIPTION OF THE DRAWINGS

Referring to the drawings wherein like reference numerals indicate similar parts throughout the several views, several aspects of the present invention are illustrated by way of example, and not by way of limitation, in detail in the figures, wherein.

DETAILED DESCRIPTION OF THE EMBODIMENTS

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

Field experience shows intermittent failure as the leading factor contributing to reduced reliability, which suggests that generally accepted practices in the art have failed to address the root causes. Reduced reliability is particularly detrimental when it manifests itself as unacceptable downtime, lost production and increased operating costs.

Transporting large compressors over land requires adherence to road transport standards, which further increases transportation costs due to limits on trailer/skid size and weight. Having considered feedback from field experience, it was found that the large mobile compressors currently in service suffer from excessive wear and tear during operation.

Mobile natural gas compressors may be employed in order to improve cost-effectiveness in reusing natural gas compression assets. Without limiting the invention, mobile compressors are assembled on a trailer having wheels. The wear and tear is aggravated by: the inherent weight-reduction manufacture methods required for mobile compressors, the typical rough terrain over which the mobile compressors have to be transported to, and the unsettled terrain on which such compressors are installed for operation at, the geographically remote site.

In accordance with an embodiment of the invention, trailer implementations addressing wear and tear during transport include the use of air-ride equipment, the trailer being configured such that a mobile natural gas compression package sits on dolly legs, and the rear springs and wheels during operation thus contributing to the reduction of cost overheads by reducing site preparation costs and downtime. In accordance with the embodiment of the invention, a rig mat may be employed under the trailer to further reduce site preparation costs.

Figure 2:
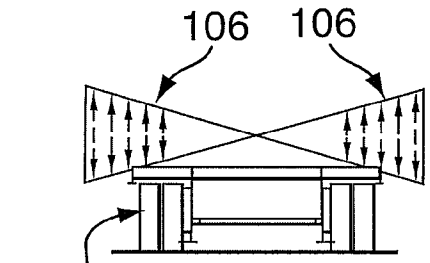
FIG. 2 is a back end view of the flexible trailer frame shown in FIG. 1.
Figure 1:
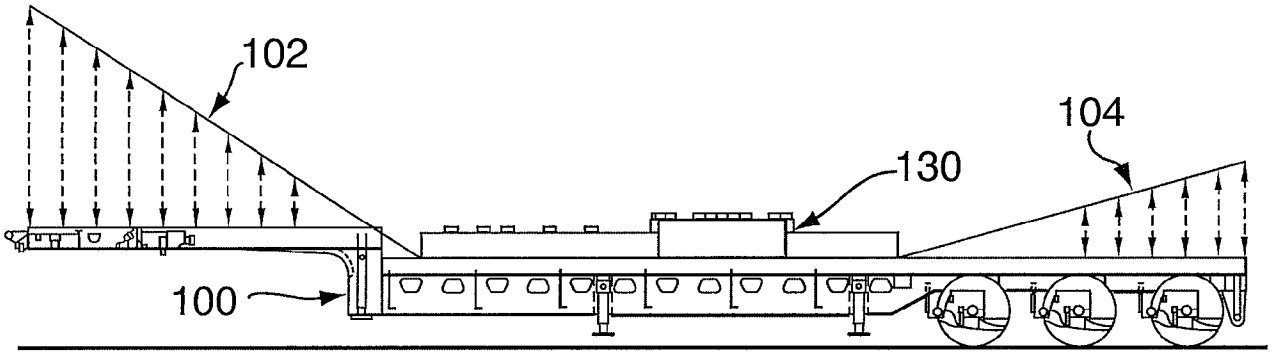
FIG. 1 is a side elevation view of a flexible pre-cambered trailer frame for a mobile natural gas compression package in accordance with an embodiment of the invention.

In accordance with an embodiment of the invention, the trailer may include a flexible frame, which improves longevity and reliability by absorbing and dissipating vibration during operation, and jarring during transport over gravel roads and uneven terrain. FIGS. 1 and 2, show a flexible trailer frame 100, the arrows 102, 104, and 106 showing, in an exaggerated fashion, the front end tongue portion of the trailer frame flexing, the back end of the trailer frame flexing, and the trailer frame twisting, respectively.

In accordance with an implementation of the embodiment of the invention shown in FIG. 1, the flexible frame includes a pre-cambered frame 100, which is particularly suited for withstanding bending during transport while allowing vibration absorption and dissipation during sustained operation. In general, the amount of pre-camber varies with the width and length of the trailer, and with the weight of the compression package components.

Figure 3:
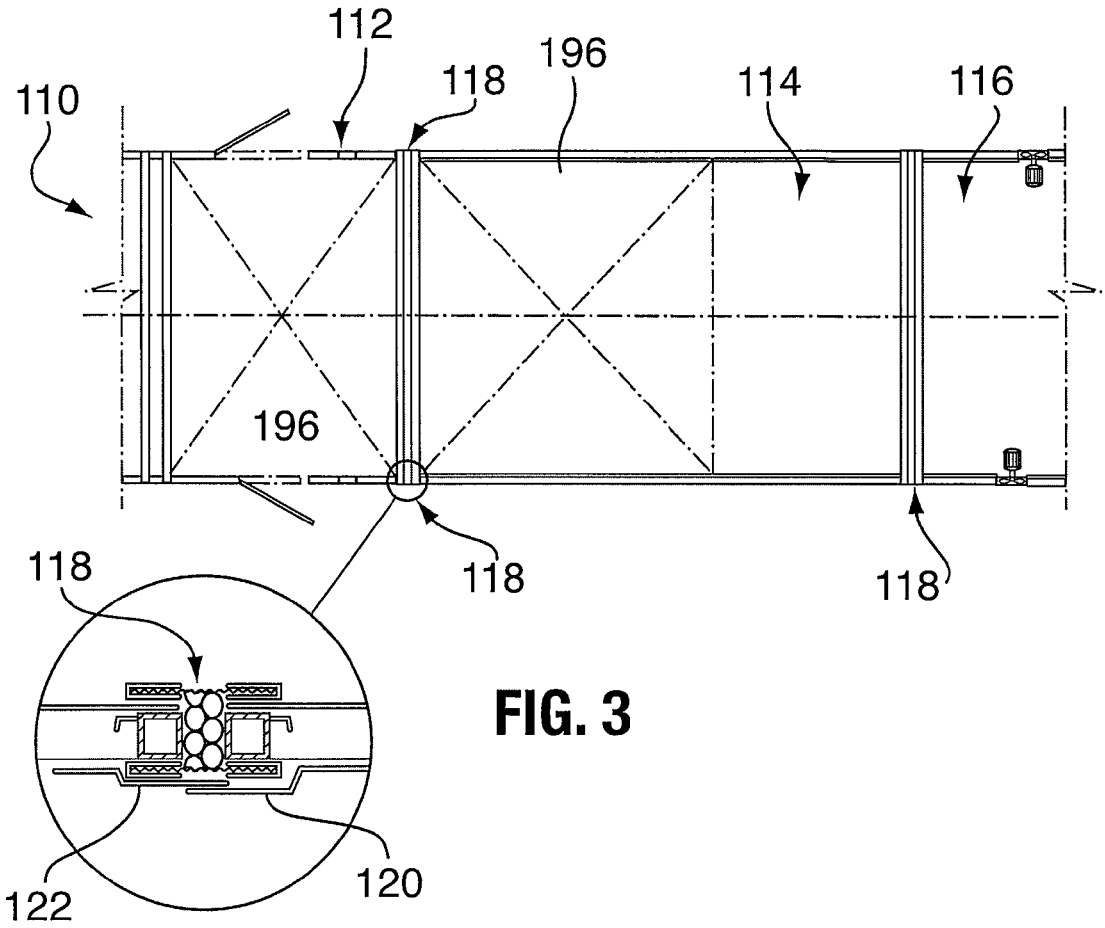
FIG. 3 is a top plan view of a housing configured to protect mobile natural gas compression package components installed on a flexible trailer frame from the elements.

In accordance with another implementation of the embodiment of the invention shown in FIG. 3, with the pre-cambered and/or flexible frame 100 allowing for deflection, a housing 110 may configured to expand and contract as the trailer frame 100 flexes while protecting the compression package components in its interior against the elements. For example, housing expansion may be provided by a sectional building (110) having sections 112, 114, 116 and expansion joints 118 between adjacent building sections 112/114, 114/116. The invention is not limited to expansion joints of the type shown, and may include overlapping flaps 120, 122. Alternatively, a bellows-like sleeve (not shown) may be used between building sections 112/114, 114/116 to provide the necessary protection against the elements. Furthermore, a secondary frame (not shown) may be used.

As previously stated herein above, the relative movement allowed by a flexible trailer frame is particularly well suited for bending during transport and vibration absorption and dissipation. However, such relative movement would lead to catastrophic failure of some compression package components including, but not limited to, the engine and compressor. In accordance with the embodiment of the invention shown in FIGS. 1, and 4, the trailer may include an inflexible sub-skid 130 for supporting at least the engine 132 and compressor 134, the flexible frame 100 flexing about the inflexible sub-skid 130. The sub-skid 130 ensures that sub-skid mounted components form a single cohesive unit and do not move relative to one another during transport and operation. The sub-skid 130 may include an arrangement of reinforcing stringers 136, an example of which is shown in FIG. 5. Rigid connections between sub-skid mounted components reduce wear, reduce maintenance downtime, and therefore increase reliability of such a mobile compression package.

Figure 6:
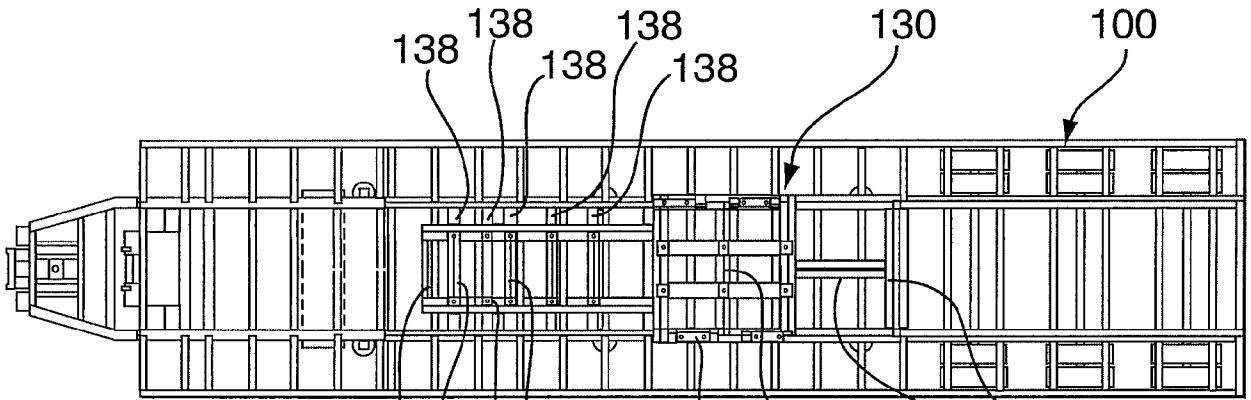
FIG. 6 is a top plan view of a combined arrangement of stringers of the flexible trailer frame and of the inflexible sub-skid.

In accordance with an implementation of the invention shown in FIG. 6, the sub-skid 130 may be rigidly attached to the flexible frame 100. Additional stringers 138 may be used in the construction of the trailer frame 100 under the sub-skid 130 in order for the trailer frame 100 to have increased rigidity under the sub-skid 130. Improved rigidity may be attained by employing a stringer (136/138) spacing between 0.5 ft and 2.5 ft, while good rigidity may be attained by employing a stringer (136/138) spacing between 1 ft and 2 ft. Various attachment means between the trailer frame 100 and sub-skid 130 may be employed such as, but not limited to, welding. Rigid attachment may be provided by welding stringers 136 of the sub-skid 130 to the stringers 138 to between 80% and 100% of the possible outside welding area, and by partially welding stringers 136 and 138 at least to 25% of the possible inside welding area. Field experience shows a substantial improvement in reliability may be gained when the inside welding has between 40% and 60% coverage.

Figure 7:
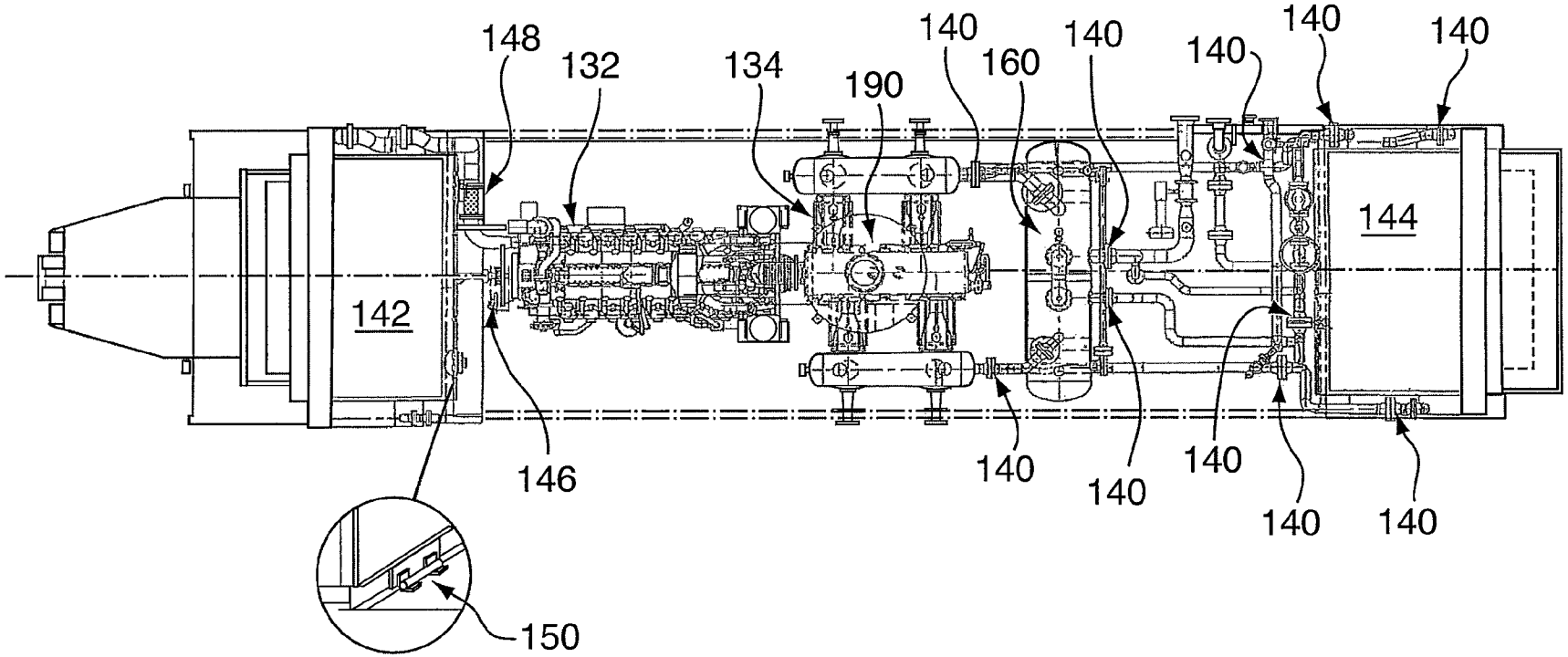
FIG. 7 is a top plan view of interconnected compression package components.

In accordance with the embodiment of the invention, increased allowance may be made for ancillary compression package components not affixed to the sub-skid 130 to tolerate as much relative movement as practical during transport. A multitude of break flanges 140 may be employed, as shown in FIG. 7, between compression package components affixed to the sub-skid 130 and ancillary compression package components affixed to the rest of the flexible frame 100. Break flanges 140 may further be employed between ancillary compression package components affixed to the flexible frame 100 only. The break flanges 140 may be disconnected or loosened to allow the compression package to flex during transport. The break flanges 140 are tightened on site before operation.

Figure 8:
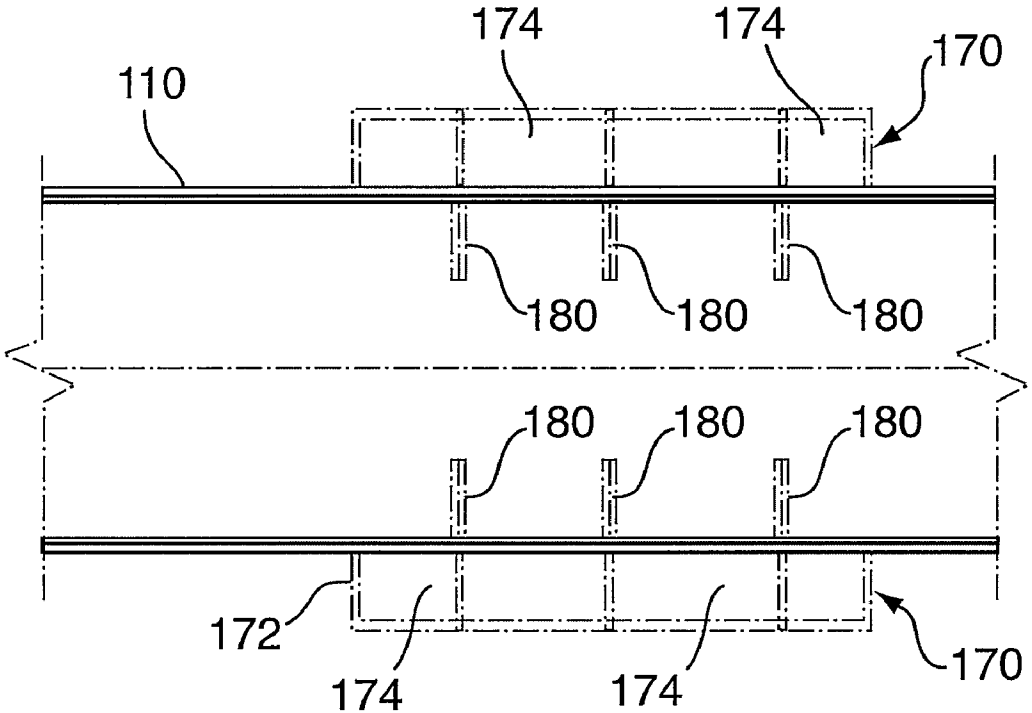
FIG. 8 is a top plan view a mobile compression package housing having a pullout arrangement.

A unitary mobile natural gas compression package further includes cooler components. For example, FIG. 8 shows a cooler 142 which may be employed to cool at least the engine 132, and cooler 144 which may be employed to cool the natural gas. Both coolers 142 and 144 represent examples of compression package components affixed to the flexible frame 100.

For example, the natural gas cooler 144 is driven hydraulically and therefore connectivity to sub-skid 130 mounted components may include the use of break flanges 140 as mentioned above. The engine cooler 142 may be affixed to the trailer tongue, which is particularly flexible. FIG. 1 shows the trailer tongue being relatively more flexible 102 than the back wheeled portion of the trailer (104). The engine cooler 142 may be belt driven 146 directly by the engine 132 while the engine coolant is circulated through piping which may include sections of braided hose 148. Engine cooler drive belts (146) may be removed or loosened during transport. The uneven terrain on which the mobile natural gas compression package may be installed may induce misalignment between the engine cooler 142 and the engine 132.

In accordance with another implementation of the embodiment of the invention, misalignment between the engine cooler 142 on the flexible frame 100 and the engine 132 on the inflexible sub-skid 130 may be achieved by hinging 150 engine cooler 142 on the side closest to the engine 132, and by employing an adjustable cooler support. The adjustable cooler support may include a jacking bolt arrangement provided to adjust the position of cooler 132 so as to align drive belt pulleys (146) and reduce stress on the braided hose 148. The adjustable cooler support may further be employed to properly tension the drive belts 142 in order to ensure proper cooling. Poor tension may also lead to premature drive belt wear or slip. Proper engine cooling reduces downtime and therefore increases reliability of the overall unitary mobile natural gas compression package.

Figure 4:
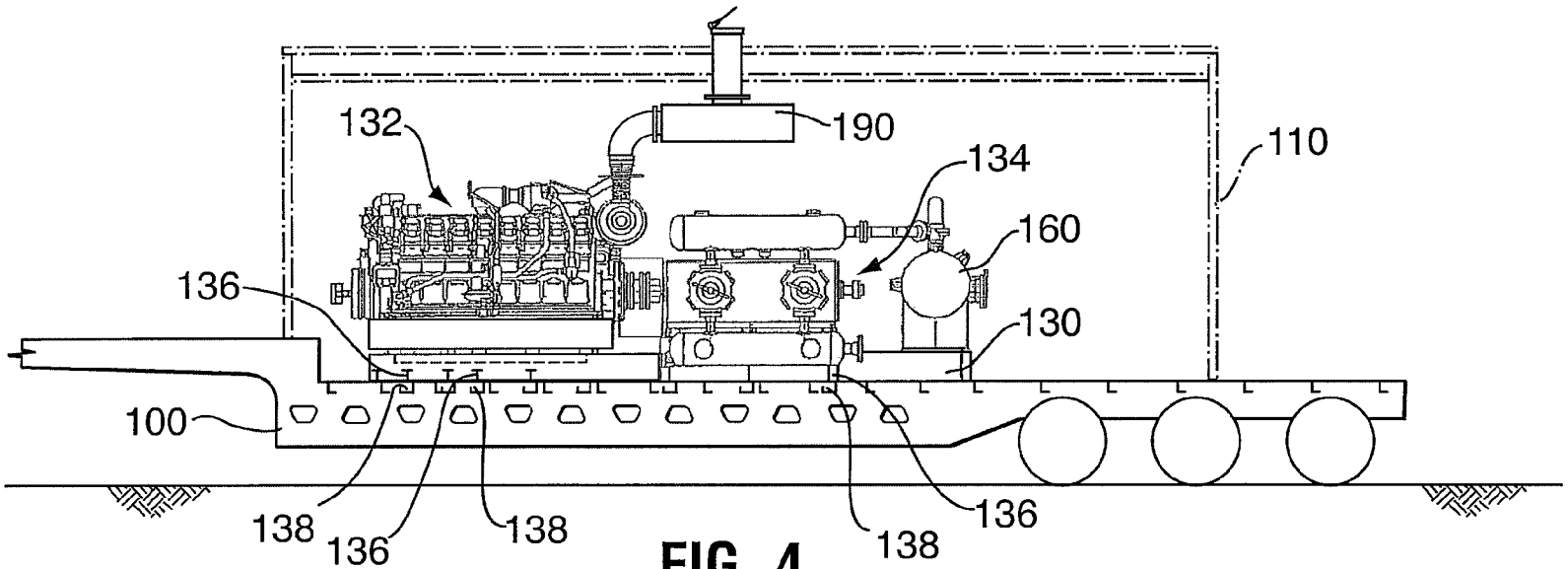
FIG. 4; is a side elevation view of the trailer having a compression components on an inflexible sub-skid.
Figure 5:
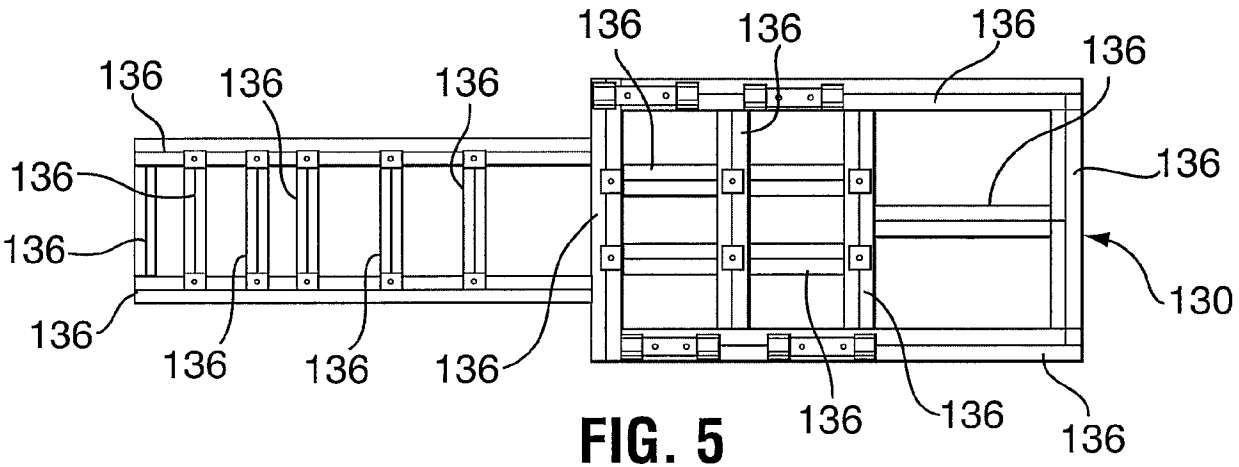
FIG. 5 is a top plan view of an arrangement of stringers of the inflexible sub-skid shown in FIG. 5.

In accordance with a further implementation of the embodiment of the invention, a gas scrubber component 160 may also be affixed to the inflexible sub-skid 130 as shown in FIGS. 4 and 7. Field experience shows improved reliability by mounting the scrubber 160 horizontally and as low as possible on the sub-skid 130, as reduced vibration is experienced when the center of gravity is lowered.

Figure 9:
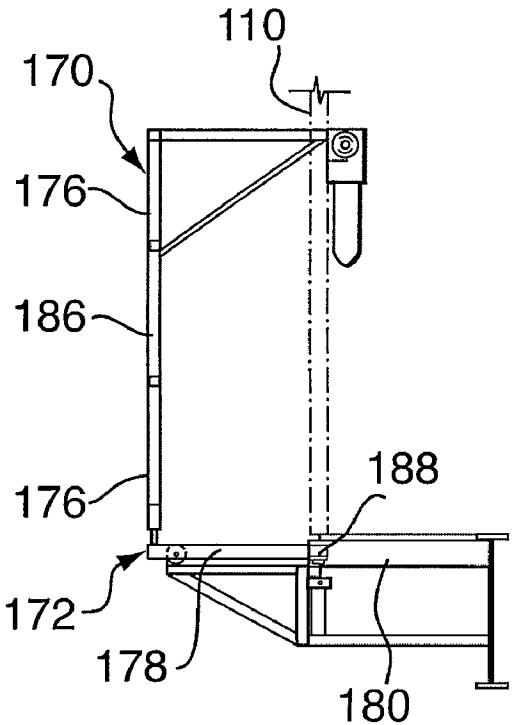
FIG. 9 is a sectional view showing an extended pullout.

In accordance with the embodiment of the invention, the housing 110 of the mobile unitary high horsepower compression package may include a pullout arrangement 170 as shown in FIGS. 8 and 9. The pullout arrangement 170 addresses adherence to trailer size restrictions specified in the relevant transport standards, while providing adequate access to the compression package components during use and maintenance, without compromising protection against the elements at all times. The provision of adequate access to compression package components under varying environmental conditions improves reliability via improved maintenance access resulting in reduced production losses.

In accordance with an implementation of the embodiment of the invention, the pullout arrangement 170 may include a pullout platform 172, sectional floor panels 174, and sectional sidewall panels 176. During transport, the pullout platform 172 is stowed substantially flush with or within the trailer having a transport standards compliant size. During use, the pullout platform 172 improves ease of use of the mobile compression package, and improves maintenance access to parts and components the operational parameters of which have to be confirmed regularly. The verification of operational parameters further improves reliability through reduced downtime.

The pullout platform 172 itself may have a frame 178. The trailer frame 100 may include apertures 180 sized to receive the portions of the pullout frame 172 during transport, and optionally to provide anchoring for the pullout frame 172. The pullout frame 172 may include modular components such as, but not limited to, insulated wall sections and/or floor sections, removable insulation members, translucent/transparent panels 186 allowing ambient light to enter the housing 110, and pullout platform locking elements 188, all of which may be removed and stored separately from the pull-out platform 172 during transport.

In accordance with another implementation of the embodiment of the invention, a disk style muffler 190 may be employed for sound deadening (FIGS. 4 and 7). Disk style mufflers run cooler when compared to other muffler styles of the same capacity. Also disk style mufflers emanate less radiant noise during operation. Because of reduced heat output, disk style mufflers can be insulated which further reduces the radiant noise output. For this reason, the insulated disk style muffler may be installed inside the housing 110 to further reduce radiant noise during operation and overall transportation height.

In accordance with a further implementation of the embodiment of the invention, the housing 110 may include removable roof panels 196 (shown in FIG. 3) providing access to compression package components for maintenance, and quick replacement, which improves turnaround times. The removable roof panels 196 may be used in combination with the disk style muffler 190 installed (above compressor 134) within the housing 110 as shown in FIGS. 3 and 4, wherein the disk style muffler 190 registers with at least one roof panel 196 and is removable through the roof of the housing 110 improving ease of access and maintenance.

Although various aspects of the present invention have been described herein including for example a pre-cambered flexible frame, an inflexible sub-skid, break flanges, an expandable building, a pullout platform, a disk style muffler, an adjustable cooler support, and horizontal gas scrubber, it is to be understood that each of these features may be used independently or in various combinations, as desired, in a unitary mobile high horsepower rating natural gas compression package.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

The embodiments presented herein are exemplary only, and persons skilled in the art would appreciate that variations to the embodiments may be made without departing from the spirit of the invention. The scope of the invention is solely defined by the appended claims.

We claim:

1. A mobile unitary high horsepower rated natural gas compression package comprising:

a. a trailer including i. a pre-cambered frame configured to flex during transport and in response to vibration during operation; and ii. an inflexible sub-skid attached to the flexible frame;

b. an engine driven compressor fixedly attached to the inflexible sub-skid;

c. a plurality of ancillary compression package components attached to the flexible frame; and d. an arrangement of break flanges configured to permit flexure between the compressor and at least one of the ancillary compression package components.

2. The unitary compression package claimed in claim 1, the sub-skid further comprising a plurality of stringers having spacing between 0.5 ft and 2.5 ft therebetween for improved rigidity.

3. The unitary compression package claimed in claim 2, the plurality of stringers having spacing between 1 ft and 2 ft therebetween for good rigidity.

4. The unitary compression package claimed in claim 2, the flexible frame further comprising a plurality of stringers under the sub-skid having a spacing between 0.5 ft and 2.5 ft therebetween for improved rigidity.

5. The unitary compression package claimed in claim 4, the plurality of flexible frame stringers under the sub-skid having spacing between 1 ft and 2 ft therebetween for good rigidity.

6. The unitary compression package claimed in claim 4, wherein the sub-skid stringers and the flexible frame stringers are fixedly attached over 80% to 100% of the possible outside attachment area.

7. The unitary compression package claimed in claim 4, wherein the sub-skid stringers and the flexible frame stringers are fixedly attached over greater than 25% of the possible inside attachment area.

8. The unitary compression package claimed in claim 7, wherein the sub-skid stringers and the flexible frame stringers are fixedly attached over 40% to 60% of the possible inside attachment area.

9. The unitary compression package claimed in claim 1, further comprising a horizontal gas scrubber affixed to the sub-skid.

10. The unitary compression package claimed in claim 1, further comprising a cooler and an adjustable cooler support.

11. The unitary compression package claimed in claim 10, wherein the adjustable cooler support further comprises a jacking bolt arrangement.

12. The unitary compression package claimed in claim 1, wherein trailer further comprises a wheeled trailer.

13. The unitary compression package claimed in claim 12, wherein the wheeled trailer further comprises an air-ride suspension.

14. The unitary compression package claimed in claim 1, further comprising an expansion building.

15. The unitary compression package claimed in claim 1, further comprising a pullout arrangement providing extra working area about the compression package during operation, while adhering to transport standards.

16. The unitary compression package claimed in claim 15, wherein the pullout arrangement further comprises a pullout platform.

17. The unitary compression package claimed in claim 16, wherein the pullout arrangement further comprises at least one of: a removable floor panel, a removable wall panel, an insulated removable floor panel, an insulated removable wall panel, a translucent panel, a transparent panel, a removable insulation member, and a pullout platform locking element.

18. The unitary compression package claimed in claim 16, wherein the pullout platform further comprises a pullout frame, the trailer frame further comprising at least one aperture sized to receive a portion of the pullout platform during transport to stow the pullout platform during transport within or substantially flush with the trailer frame.

19. The unitary compression package claimed in claim 18, wherein the pullout platform the pullout platform is further configured to be anchored to the trailer frame.

20. The unitary compression package claimed in claim 1, further comprising a disk style muffler providing sound deadening in use while adhering to transport standards.

21. The unitary compression package claimed in claim 1, further comprising at least one removable roof panel configured to provide access to compression package components.

22. The unitary compression package claimed in claim 21, further comprising a removable disk style muffler aligned with the at least one removable roof panel.

* * * * *